US007600844B2

(12) United States Patent
Morimoto

(10) Patent No.: US 7,600,844 B2
(45) Date of Patent: Oct. 13, 2009

(54) INK JET PRINTER IN WHICH A BEST TEST PATTERN PRINTED IN A RECORDING MEDIUM IS AUTOMATICALLY SELECTED

(75) Inventor: Yoshinari Morimoto, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 472 days.

(21) Appl. No.: 10/625,778

(22) Filed: Jul. 24, 2003

(65) Prior Publication Data

US 2004/0141022 A1 Jul. 22, 2004

(30) Foreign Application Priority Data

Jul. 26, 2002 (JP) ..... 2002-218156

(51) Int. Cl.
*B41J 29/393* (2006.01)

(52) U.S. Cl. ..... 347/19

(58) Field of Classification Search ..... 347/19
See application file for complete search history.

(56) References Cited

U.S. PATENT DOCUMENTS 6,164,745 A 12/2000 Nagoshi et al.
6,215,562 B1 * 4/2001 Michel et al. ..... 358/1.9
6,257,143 B1 7/2001 Iwasaki et al. ..... 347/19
6,454,390 B1 * 9/2002 Takahashi et al. ..... 347/19

FOREIGN PATENT DOCUMENTS

| | | |
|---|---|---|
| JP | A 7-81190 | 3/1995 |
| JP | A 8-90835 | 4/1996 |
| JP | A10-6533 | 1/1998 |
| JP | A 10-329380 | 12/1998 |
| JP | A 2000-37936 | 2/2000 |

* cited by examiner

*Primary Examiner*—Julian D Huffman
(74) *Attorney, Agent, or Firm*—Oliff & Berridge, PLC

(57) ABSTRACT

In an ink jet printer, upon a start of a go/return printing position automatic correction control, on the basis of plural preset test pattern numbers, plural kinds of test patterns are printed while a shift amount of return-printing is changed, and each of the test patterns are read by a medium sensor and converted into digital data. For each test pattern, a maximum value, a minimum value, and a center value of AD values (digital numerical values of gradation data) are determined, an amplitude value that is the sum of deviations that are the differences between the AD values and the center value are calculated, and a test pattern having a smallest amplitude value is judged best. A shift amount and a test pattern corresponding to the test pattern having the smallest amplitude value are printed.

16 Claims, 17 Drawing Sheets

FIG. 7

| TEST PATTERN NO. | SHIFT AMOUNTS (NUMBER OF DOTS) |
|---|---|
| 0 | -12 |
| 1 | -8 |
| 2 | -4 |
| 3 | 0 |
| 4 | 4 |
| 5 | 8 |
| 6 | 12 |

FIG. 13

| TEST PATTERN NO. | AMPLITUDE VALUES |
|---|---|
| 0 | D0 |
| 1 | D1 |
| 2 | D2 |
| 3 | D3 |
| 4 | D4 |
| 5 | D5 |
| 6 | D6 |

INK JET PRINTER IN WHICH A BEST TEST PATTERN PRINTED IN A RECORDING MEDIUM IS AUTOMATICALLY SELECTED

BACKGROUND OF THE INVENTION

1. Field of the Invention

The present invention relates to an ink jet printer that conducts printing while reciprocating a print head, and more particularly to an ink jet printer in which a printing positional deviation of return-printing with respect to go-printing is automatically corrected.

2. Description of the Related Art

Various ink jet printers have been put in practical use in which color printing is generally conducted on a sheet in such a manner that a print head having a large number of ink jet nozzles jet out ink supplied from ink cartridges into ink droplets bit by bit. To increase the printing speed, ink jet printers called "bidirectional printing" have been put in practical use which not only conducts go-printing (go-direction printing) while moving the print head in a forward direction, but also conducts return-printing (return-direction printing) while moving the print head in a backward direction.

In ink jet printers that can bidirectionally print, a printing positional deviation tends to occur between go-printing and return-printing because of the following factors: backlash exists in a carriage driving mechanism during each of a go-direction movement and a return-direction movement; a positional deviation exists between a go-printing position at which ink jetted during go-printing adheres to a sheet and a return-printing position at which ink jetted during return-printing adheres to the sheet; and a go-printing speed and a return-printing speed slightly differs from each other. Various proposals have been made to prevent such a printing positional deviation.

For example, in a serial printer disclosed in JP-A-10-329380, a number-of-correction-steps table is stored in advance in which line numbers (1, 2, 3, . . . , 9, 0) and the numbers of correction steps in return-printing correlate with each other. When printing position correction processing is executed, a line number, a vertical ruled-line pattern of go-printing, and a vertical ruled-line pattern of return-printing are printed on the same line for each line number. An inspector or a user determines, by a visual check, a vertical ruled-line pattern having a smallest printing positional deviation, and sets the corresponding line number as deviation correction data for printing control by inputting the line number to the serial printer.

In a printing apparatus disclosed in JP-A-10-6533, every time the head cartridge of an ink jet recording apparatus is replaced, plural kinds of test patterns are printed while the ink jetting timing conditions change between go-printing and return-printing in different manners. The plural kinds of printed test patterns are read by scanning those test patterns by an optical reading means provided in the recording apparatus, and an optimum test pattern that is closest to a proper image pattern that is free of deviations is automatically determined. The ink jet recording apparatus itself automatically sets the optimum test pattern as corresponding to the best jetting timing conditions.

As described above, in the serial printer disclosed in JP-A-10-329380, the inspector or the user determines a vertical ruled-line pattern having a smallest printing positional deviation on the basis of a vertical ruled-line pattern of go-printing and a vertical ruled-line pattern of return-printing that are printed on the same line for each line number, and manually sets the corresponding line number as deviation correction data for printing control. This raises various problems. For example, the correcting manipulations for the printing positional deviation correction becomes complex. Where there are a plurality of line numbers among which a line number for printing positional deviation correction is to be selected, an error likely occurs in setting a line number corresponding to the best pattern.

In the printing apparatus disclosed in JP-A-10-6533, plural kinds of test patterns are printed while the ink jetting timing conditions change between go-printing and return-printing in different manners. An optimum test pattern can be determined and set automatically by scanning those test patterns by the reading means. However, there remain several problems. For example, an inspector cannot recognize which is the optimum test pattern that has been set automatically, and cannot visually check whether the test pattern that has been determined to be the best test pattern is really the best one.

SUMMARY OF THE INVENTION

The present invention has been made to solve the above problems, and therefore one object of the present invention is to automatically correct a printing positional deviation of return-printing with respect to go-printing.

Another object of the invention is to print, for a visual check, the best test pattern that has been set for automatic correction.

According to an aspect of the invention, there is provided an ink jet printer including: a printing unit having a carriage and a print head in which a plurality of ink jet nozzles are arranged in plural columns, the printing unit printing on a printing medium while reciprocating the print head by the carriage for go-printing and return-printing; a sensor disposed on the carriage and having a light-emitting portion for emitting light toward the printing medium and a light-receiving portion for receiving reflection light; a test pattern printing control unit that causes the printing unit to print a test pattern in which vertical ruled lines are arranged with a prescribed pitch; a plural patterns printing instructing unit that causes the printing unit to print a plurality of test patterns while changing a test pattern printing interval of the return-printing with respect to the go-printing in plural stages; a best pattern detecting unit for scanning-in the printed test patterns with the sensor and for automatically selecting a best test pattern from the scanned-in test patterns; and a, best pattern printing instructing unit that causes the printing unit to print best test pattern related information on the printing medium.

A plurality of test patterns are printed while the test pattern printing interval of return-printing with respect to go-printing is changed in plural stages in such a manner that each test pattern in which vertical ruled lines are arranged with a prescribed small pitch is printed by reciprocation of the carriage. The printed test patterns are scanned-in by the sensor and analyzed, whereby one of the scanned-in test patterns is selected automatically as the best one. Best test pattern related information is printed on the printing medium. Therefore, an inspector can visually check whether the test pattern that has been judged best in the printing control, is really the best one.

BRIEF DESCRIPTION OF THE DRAWINGS

These and other objects and advantages of this invention will become more fully apparent from the following detailed description taken with the accompanying drawings in which:

FIG. 7 is a table in which test pattern numbers and shift amounts are correlated with each other;

FIG. 13 is a table in which test pattern numbers and amplitude values are correlated with each other;

DETAILED DESCRIPTION OF THE PREFERRED EMBODIMENTS

First Embodiment

An embodiment of the present invention will be hereinafter described with reference to the accompanying drawings.

This embodiment is directed to a multifunctional apparatus having a telephone function, etc., in addition to a printer function, a copier function, a scanner function, and a facsimile function.

Figure 1:
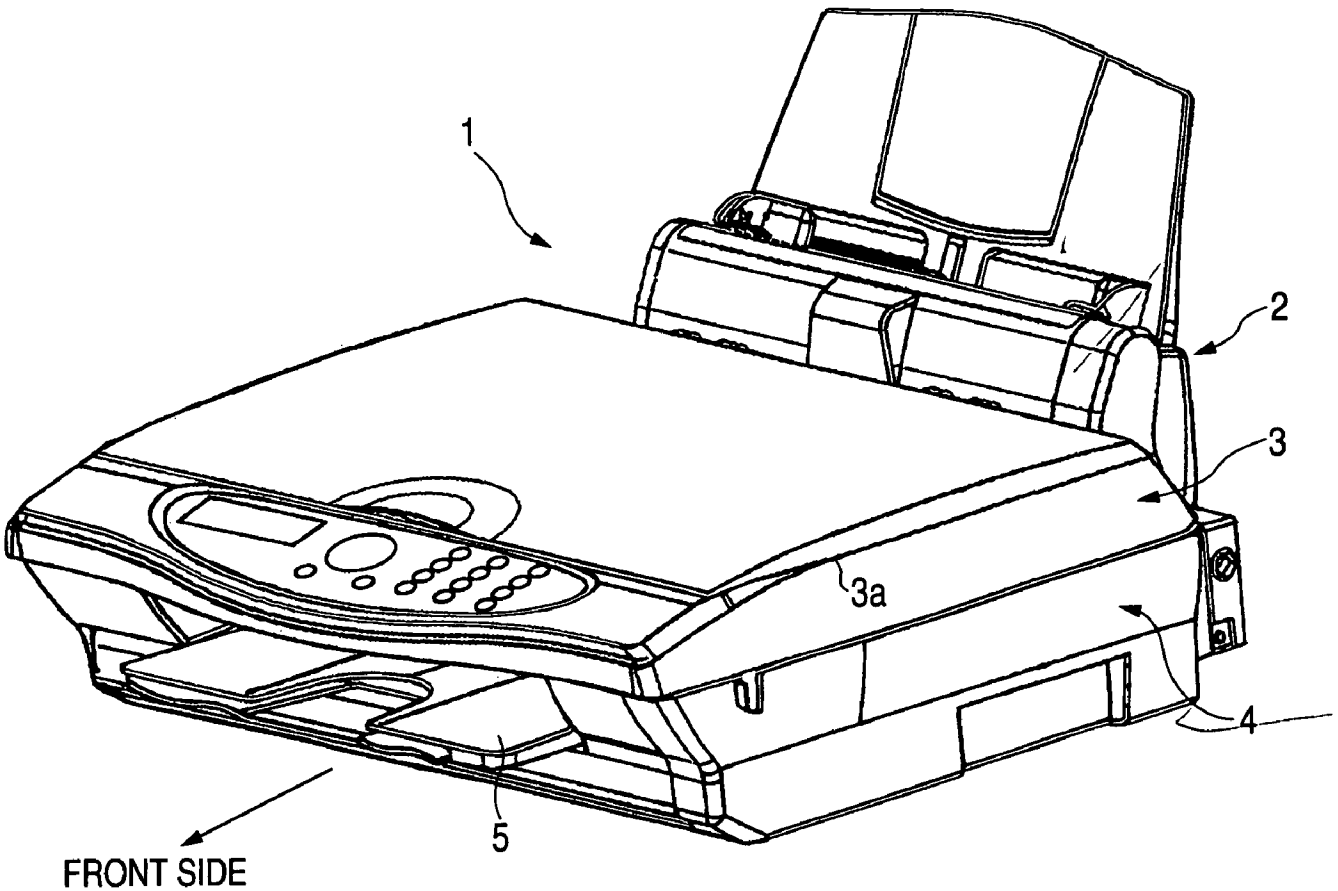
FIG. 1 is a perspective view showing a multifunctional apparatus according to an embodiment of the present invention.

As shown in FIG. 1, a multifunctional apparatus 1 is equipped with a sheet feeder 2 on a back side thereof. A document reading device 3 for the copier function (scanner function) and the facsimile function is disposed so as to occupy a top portion of a section in front of the sheet feeder 2. An ink jet printer 4 as an implementation of the printer function is disposed so as to occupy the entire portion under the document reading device 3. A table 5 for ejection of printed sheets is disposed in front of the ink jet printer 4.

The document reading device 3 is structured as follows (not shown in FIG. 1). The document reading device 3 can be swung vertically around a horizontal axis that is located at the rear end. If a top cover 3*a* is opened upward, a user can see a document placement glass plate. An image scanning device for document reading is disposed under the glass plate. By opening the document reading device 3 upward by hand, the user can replace ink cartridges 40-43 of the ink jet printer 4 or maintain a print mechanism section 10. That is, the ink jet printer 4 is disposed in front of the sheet feeder 2 in a manner as shown in FIG. 2.

Subsequently, the ink jet printer 4 will be described with reference to FIG. 2.

The ink jet printer 4 includes the print mechanism section 10 for printing on a sheet (e.g., A4-sheet) supplied from the sheet feeder 2 by jetting ink droplets from a print head 23P, a maintenance mechanism section 11 for performing maintenance processing on the print head 23P, an ink supply section 12 for supplying inks from the ink cartridges 40-43 to the print mechanism section 10, an air supply section 13 for supplying pressurized air to the ink cartridges 40-43, and other sections. First, the print mechanism section 10 will be described.

Figure 2:
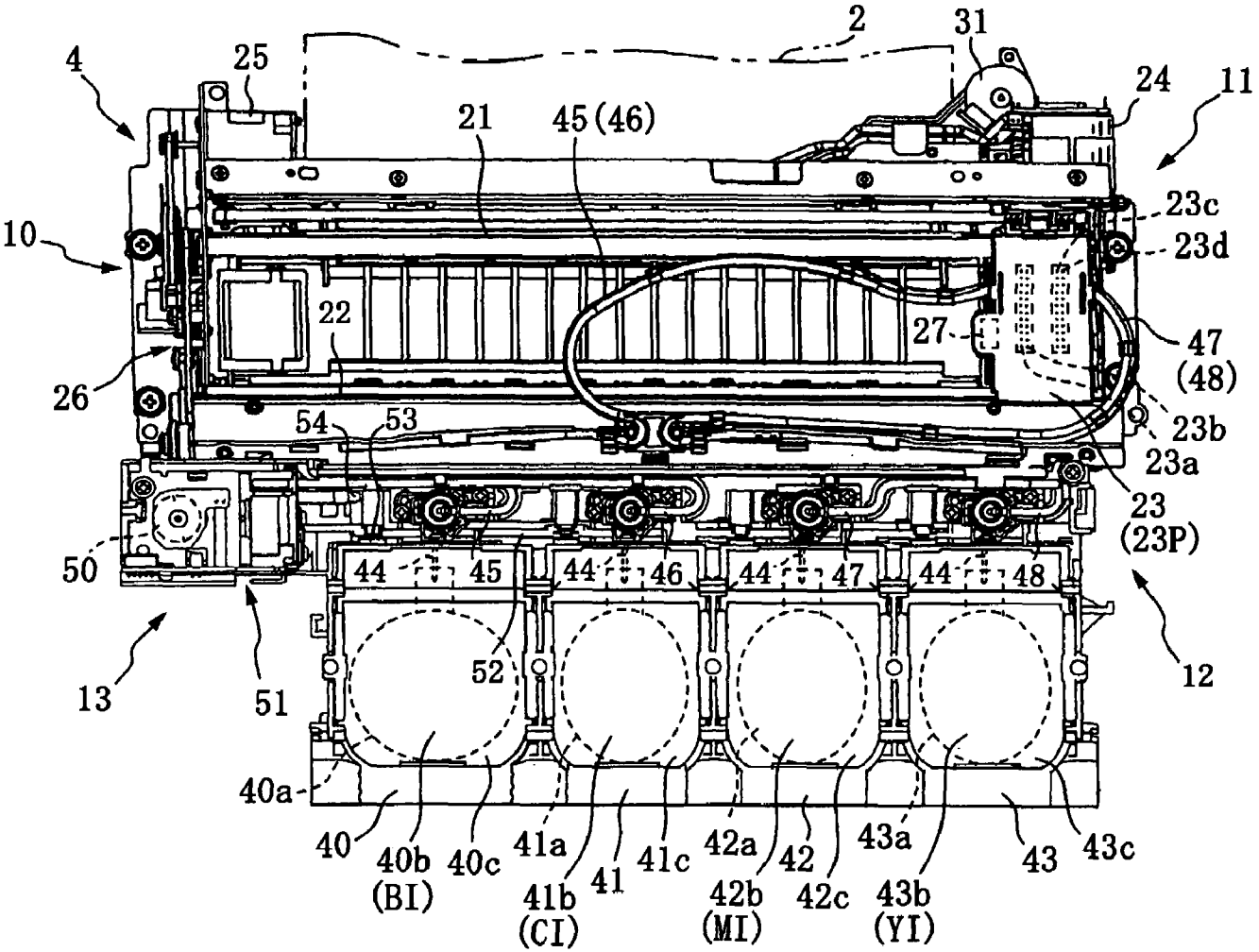
FIG. 2 is a plan view showing internal mechanisms of an ink jet printer.

As shown in FIG. 2, the print mechanism section 10 includes a carriage 23 that is housed compactly in a box-shaped print unit frame (not shown) and supported by a guide rail 22 and a guide shaft 21 that are disposed on the front side and the rear side, respectively, a carriage driving motor 24 for reciprocating the carriage 23 in the right-left direction via a wire (not shown), and other members. The carriage 23 itself also serves as the print head 23P. A number of ink jet nozzles (hereinafter referred to as "nozzles") 23*a*-23*d* are arranged on the bottom surface of the print head 23P in four columns in the right-left direction so as to correspond to four ink colors.

The nozzles 23*a*-23*d* are equipped with respective piezoelectric elements (not shown), and very small amounts of ink are jetted from piezoelectric-element-energized ones of the nozzles 23*a*-23*d* toward a sheet. A main transport roller, which is called "registration roller", is disposed under the guide shaft 21. The main transport roller rotates in a prescribed direction by a sheet feed motor 25 via a gear mechanism 26 to transport a sheet that is supplied from the sheet feeder 2 toward the front side (i.e., in a sheet feed direction) while moving the sheet approximately horizontally right under the print head 23P, and to eject the sheet to the ejection table 5. An optical medium sensor 27 (corresponding to "sensor") is attached downward to the left end portion of the carriage 23.

The medium sensor 27 is equipped with a light-emitting portion 23*a* for emitting light toward a sheet below and a light-receiving portion 27*b* for receiving light reflected from the sheet. By using the medium sensor 27, the front end and the rear end and the width of a sheet being fed can be detected. Further, when the carriage 23 is moved in the right-left direction after printing, a printed image is scanned in line form, whereby a density profile of the image can be read as analog data.

Subsequently, the maintenance mechanism section 11 will be described briefly. A thin-plate-shaped rubber wiper blade and rubber head caps (both not shown) are disposed upward under the print head 23P as shown in FIG. 2. When a maintenance motor 31 rotates in a normal direction, the wiper blade moves upward and downward via a blade elevation mechanism (not shown). When the maintenance motor 31 rotates in a reverse direction, the head caps move upward and downward via a cap elevation mechanism (not shown).

Subsequently, the ink supply section 12 will be described.

A black ink cartridge 40, a cyan ink cartridge 41, a magenta ink cartridge 42, and a yellow ink cartridge 43 are arranged in this order from the left side in front of the ink supply section 12. Flexible film members 40*a*-43*a*, which are stretched inside the cartridge cases of the ink cartridges 40-43 so as to cover most of their entire areas, respectively, partition the cartridge cases into bottom ink accommodation rooms 40*b*-43*b* and top air rooms 40*c*-43*c*, respectively.

A black ink BI, a cyan ink CI, a magenta ink MI, and a yellow ink YI are accommodated in the ink accommodation rooms 40*b*-43*b* of the black ink cartridge 40, the cyan ink cartridge 41, the magenta ink cartridge 42, and the yellow ink cartridge 43, respectively. Ink needles 44 are disposed in the rear of the respective ink cartridges 40-43 so as to project front side. The proximal portions of the ink needles 44 are connected to the print head 23P via dedicated ink supply tubes 45-48, respectively.

When the ink cartridges 40-43 are mounted at their prescribed mounting positions, the tip portions of the ink needles 44 penetrate through the rear end portions of the film members 40*a*-43*a* and reach the ink accommodation rooms 40*b*-43*b*, respectively, whereby the inks BI, CI, MI, and YI in the ink accommodation rooms 40*b*-43*b* are supplied to the print head 23P via the dedicated ink supply tubes 45-48, respectively. The print head 23P is positioned higher than the ink cartridges 40-43 so that a prescribed head difference (e.g., 5 to 6 cm) is generated between the print head and the ink cartridges.

Therefore, the nozzles 23*a*-23*d* of the print head 23P are filled with inks BI, CI, MI, and YI supplied and a negative pressure corresponding to the head difference develops there, whereby clear meniscuses are formed at the tips of the nozzles 23*a*-23*d* so as to be curved inward.

Next, the air supply section 13 will be described.

As shown in FIG. 2, a pump motor 50 is disposed on the left of the mounting portion for the black ink cartridge 40 and an air pump 51 to be driven by the pump motor 50 is disposed immediately on the right of the pump motor 50. Pressurized air generated by the air pump 51 is supplied to the air rooms 40*c*-43*c* of the ink cartridges 40-43 via an air supply pipe 52 and pressure contact pads 53 that are urged elastically, respectively. In an ordinary state, atmospheric pressure acts on the air rooms 40*c*-43*c* via an orifice 54 that is provided at a halfway position of the air supply tube 52.

When pressurized air having a pressure higher than the negative pressure corresponding to the head difference is generated by the air pump 51, the pressurized air acts on all the ink accommodation rooms 40*b*-43*b* because the orifice 54 is set so as to supply the pressurized air to all the air rooms 40*c*-43*c* of the ink cartridges 40-43 via the air supply tube 52. The pressurized air also acts on the inks BI, CI, MI, and YI in the nozzles 23*a*-23*d*, whereby their surface shapes in the nozzles 23*a*-23*d* are changed from the meniscus shape (i.e., concave shape) to a convex shape.

Figure 3:
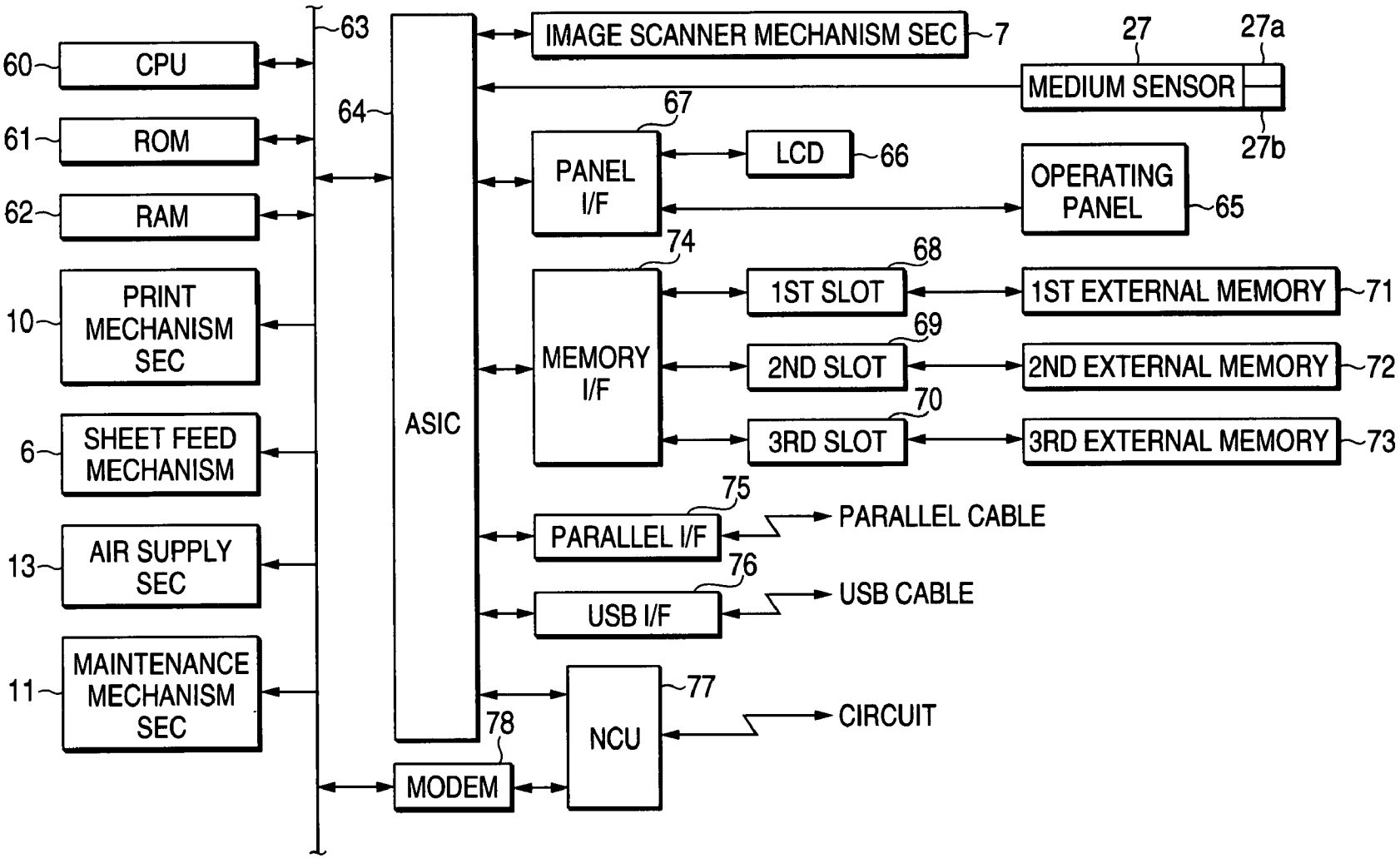
FIG. 3 is a block diagram showing a control system of the ink jet printer.

Next, a control system of the above-configured multifunctional apparatus 1 will be described with reference to a block diagram of FIG. 3.

The basic configuration is such that a CPU 60, a ROM 61, and a RAM 62 that constitute a control section are connected to each other via a bus 63 such as a data bus. The above-described print mechanism section 10, sheet feed mechanism 6, air supply section 13, and maintenance mechanism section 11, an input/output ASIC (application-specific integrated circuit) 64 consisting of hard logic circuits, and other sections are also connected to the bus 63. The CPU 60, the ROM 61, the RAM 62, the ASIC 64, interfaces 67 and 74,. etc., constitute a controller.

An image scanner mechanism section 7, the medium sensor 27, a panel interface 67 for an operating panel 65 and a liquid crystal display (LCD) 66, a memory interface 74 for a plurality of (first to third) slots 68-70, a parallel interface 75 that is connected to a parallel cable that is connected to an external printer or the like, a USB interface 76 that is connected to a USB cable that is connected to one of various kinds external apparatuses, and an NCU (network control unit) 77 that is connected to an external telephone lines are connected to the ASIC 64. Part of the NCU 77 is also connected to the bus 63 via a modem 78.

A first external memory 71, a second external memory 72, and a third external memory 70 are connected to the first slot 68, the second slot 69, and the third slot 70, respectively. Each of the first to third external memories 71-73 is CompactFlash (registered trademark), SmartMedia (registered trademark), a memory stick (registered trademark), or the like. Various control programs for implementing the above-described printer function, copier function, scanner function, facsimile function, and telephone function are stored in the ROM 61 in advance. The RAM 62 incorporates various memories such as an information storage memory for storing various data that are input via the parallel cable or the USB cable and an information transmission memory to be used for transmitting data outside via the parallel cable or the USB cable.

Next, a control program for a go/return printing position adjustment control that is stored in the ROM 61 will be described with reference to flowcharts of FIGS. 4 and 5. Go-printing vertical ruled line data in which vertical ruled lines are arranged with a prescribed small pitch for go-printing (see FIG. 6A) and return-printing vertical ruled line data in which vertical ruled lines are arranged with a prescribed small pitch for return-printing (see FIG. 6B) are stored in the ROM 61. Further, as shown in FIG. 7, a printing position shift amount (in terms of the number of dots) in return-printing is stored in the ROM 61 for each of seven kinds of test patterns.

Figure 6A:
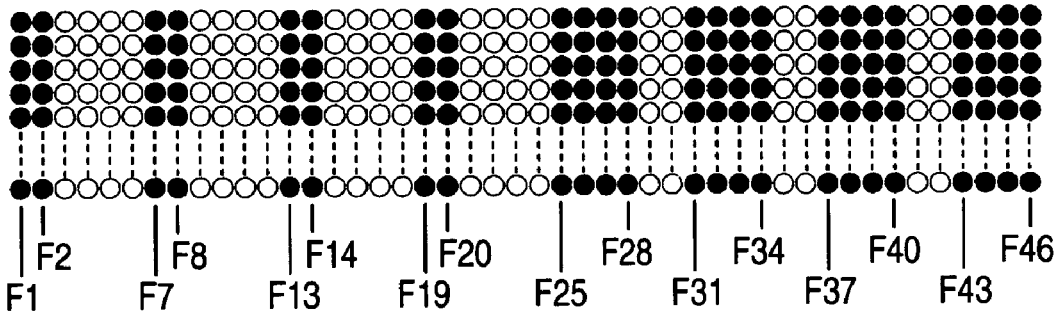
FIGS. 6A and 6B illustrate go-printing vertical ruled line data and return-printing vertical ruled line data.
Figure 6B:
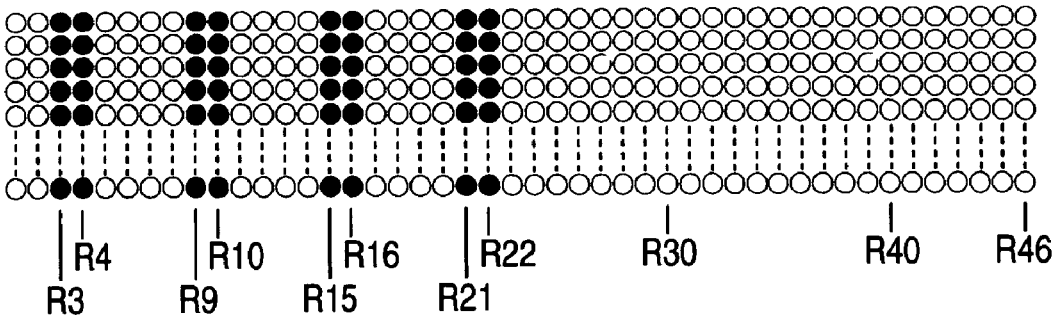

For example, as shown in FIG. 6A, the go-printing vertical ruled line data are such that F1 and F2, F7 and F8, F13 and F14, and F19 and F20 cause printing of four vertical ruled lines each being a 2-dot-width line and F25-F28, F31-D34, F37-F40, and F43-F46 cause printing of four vertical ruled lines each being a 4-dot-width line. For example, as shown in FIG. 6B, the return-printing vertical ruled line data are such that R3 and R4, R9 and R10, R15 and R16, and R21 and R22 cause printing of two vertical ruled lines each being a 2-dot-width line in addition to the vertical ruled lines printed by F1 and F2, F7 and F8, F13 and F14, and F19 and F20.

This control is executed when an inspector manipulates a go/return printing position correction key that is provided on the operating panel 65 of the ink jet printer 1 in a print test that is conducted in shipping a product in a manufacturer of the ink jet printer 1. The go/return printing position correction key may be a combination of existing keys. Upon a start of the control, a message "Set sheets." is displayed on the liquid crystal display 66 (S10). The inspector sets sheets for a test in the sheet feeder 2. When a test pattern printing key is manipulated (S11: yes), a 600-mode flag DF for setting a 600-dpi mode as a print resolution is set (S12).

If supply of a sheet has been detected by the medium sensor 27 (S13: yes), a test pattern number N is set to an initial value "0" (S14) and a shift amount of the test pattern number "0" is read (S15). Then, a test pattern is printed in such a manner that go-printing is conducted on the basis of the go-printing vertical ruled line data and return-printing is conducted on the same line (i.e., without feeding: the sheet) on the basis of the return-printing vertical ruled line data and the shift amount (S16). Then, a vertical ruled line image of the printed test pattern is read (S18) by scanning it by moving the medium sensor 27 linearly (S17).

In this case, image data, that is, gradation data representing a density profile, that have been scanned-in by the medium sensor 27 are such as to have small values in black portions (vertical ruled lines) and large values in unprinted, white portions (i.e., portions other than the vertical ruled lines). Then, the gradation data scanned-in by the medium sensor 27, that is, analog data, are converted into digital data (what is called AD values). The digital data are stored in an AD memory of the RAM 62 (S19). Then, the sheet is fed by a prescribed length (S20).

Figure 8:
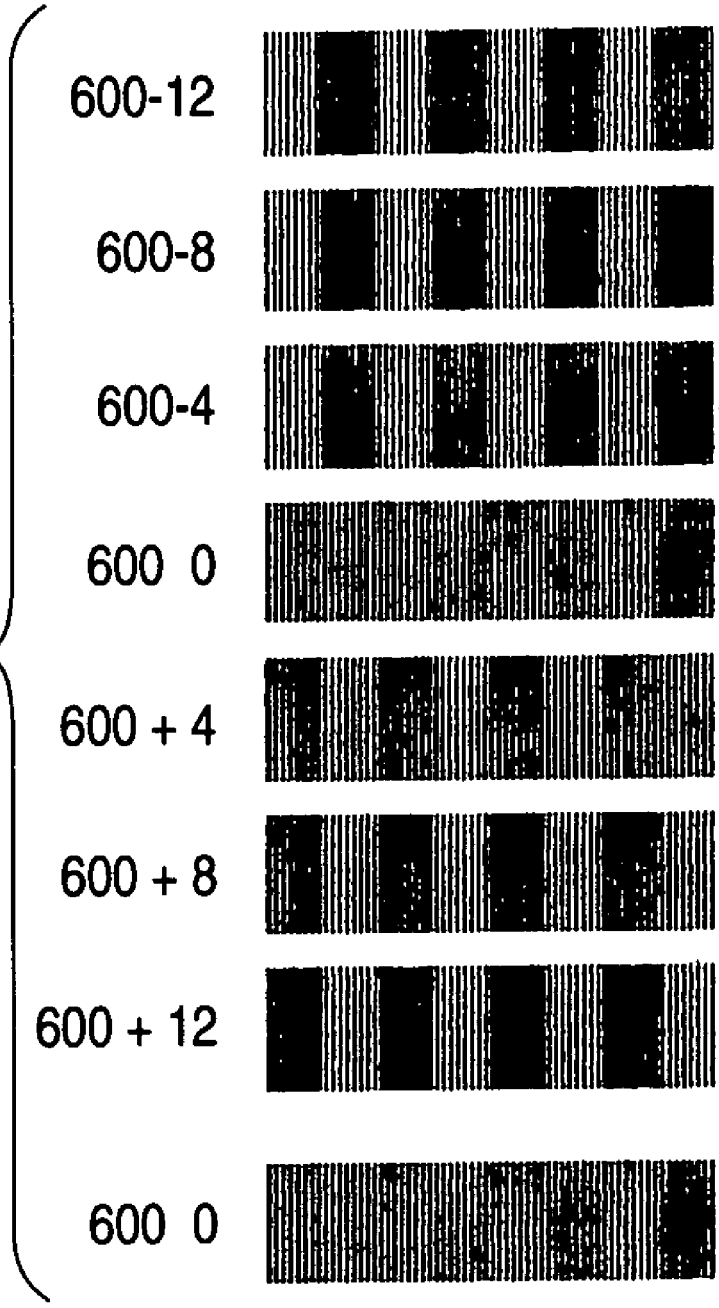
FIG. 8 shows a plurality of test patterns having different shift amounts that were printed at 600 dpi.

Then, if the test pattern number N is not equal to the maximum number (in this embodiment, 6) (S21: no), N is incremented by "1" (S22) and steps S15-S22 are executed again. For example, as shown in FIG. 8, seven kinds of test patterns are printed at a resolution of 600 dpi in such a manner that the printing positions are shifted by −12 dots, −8 dots, −4 dots, 0 dot, +4 dots, +8 dots, and +12 dots, respectively, in the return printing.

Figure 9:
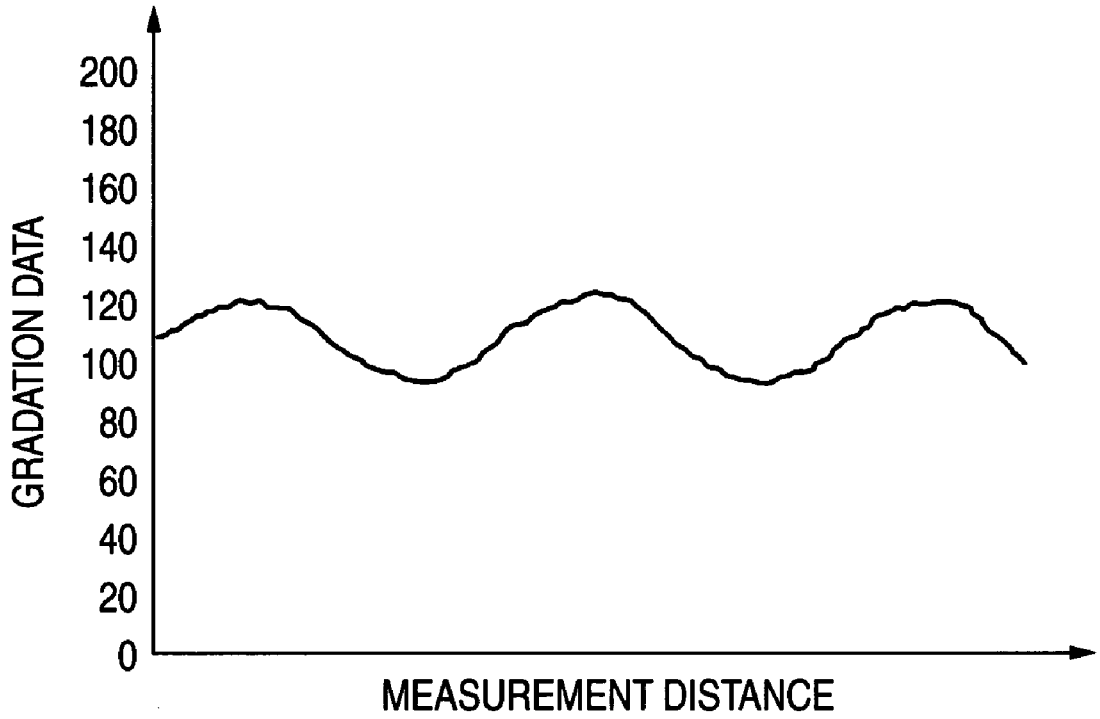
FIG. 9 shows gradation data of a case that return-printing positions are deviated from go-printing positions.
Figure 10:
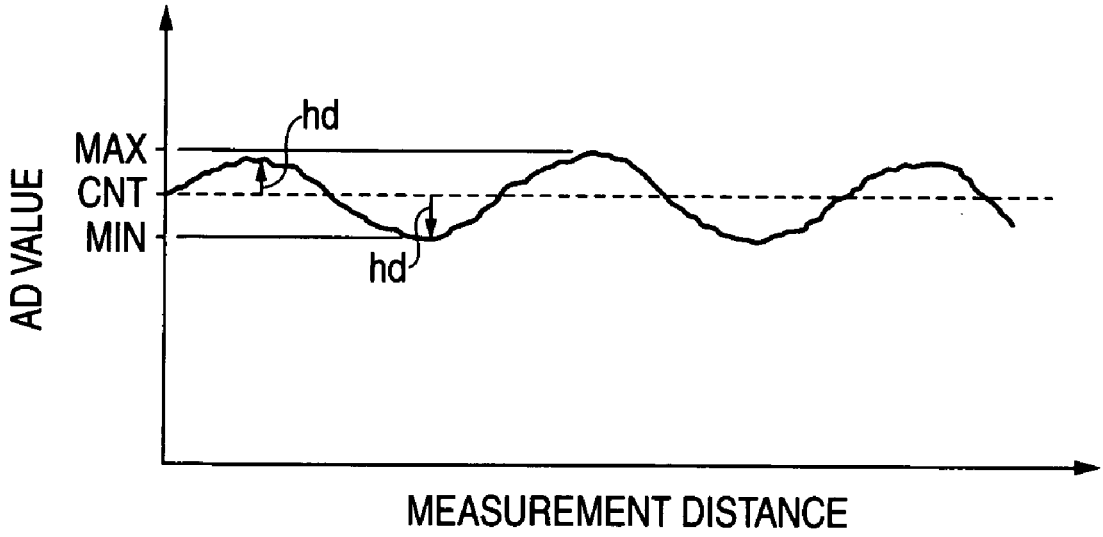
FIG. 10 shows AD values (i.e., digital numerical values corresponding to the gradation data) of the case that return-printing positions are deviated from go-printing positions.

For example, in the case of the test pattern whose shift amount is equal to −12 dots, as shown in FIG. 9, gradation data (analog data) of 256 gradation levels are measured at measurement distances that are separated from each other by a very small length. As shown in FIG. 10, digital data (AD values) are obtained by converting the gradation data into digital numerical values and stored in the AD memory of the RAM 62. When the scanned-in image is white, the gradation data in FIG. 9 becomes 255. When the scanned-in image is black, the gradation data in FIG. 9 becomes 0.

Figure 11:
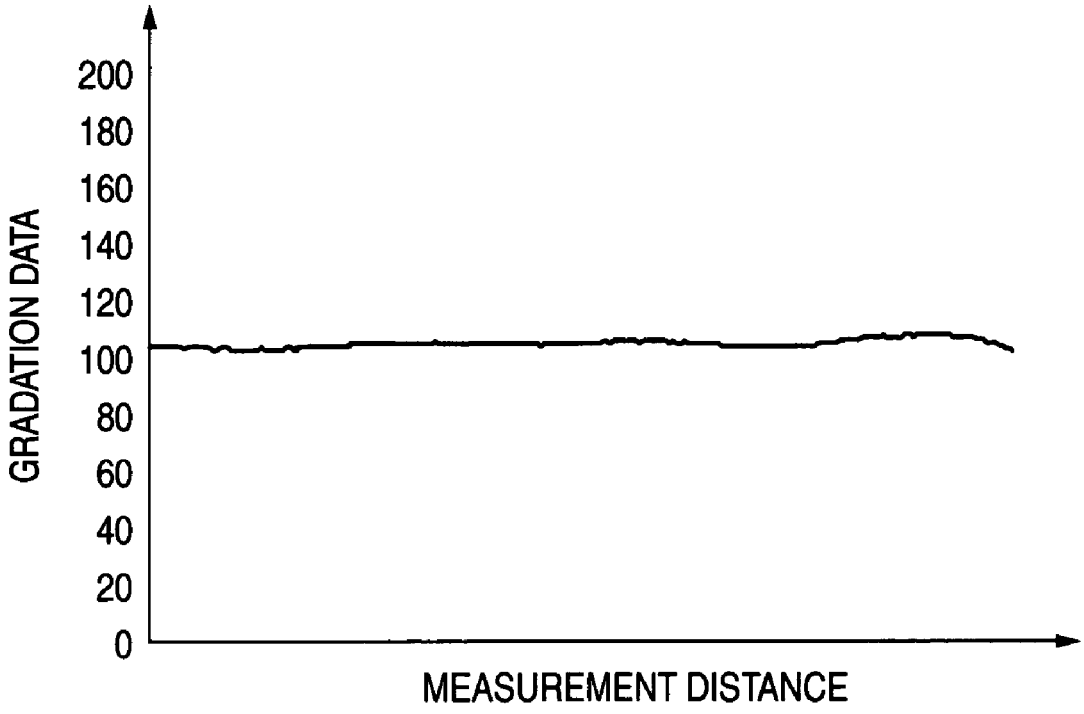
FIG. 11 is a graph corresponding to FIG. 9 and showing gradation data of a case that return-printing positions are corrected with respect to go-printing positions.
Figure 12:
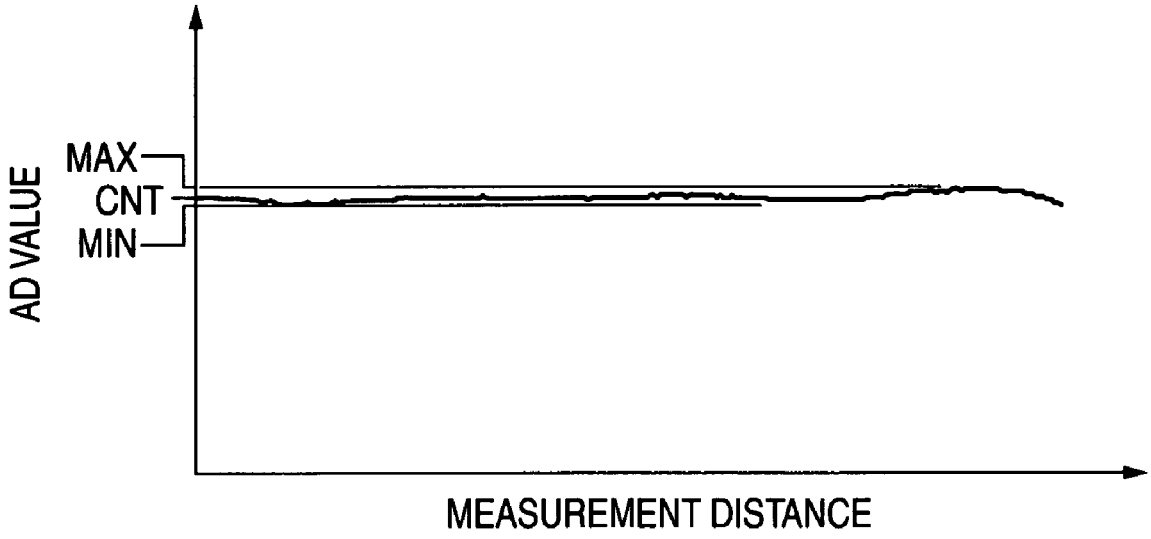
FIG. 12 is a graph corresponding to FIG. 10 and showing AD values of the case that return-printing positions are corrected with respect to go-printing positions.

In the case of the test pattern whose shift amount is equal to 0 dot, as shown in FIG. 11, gradation data (analog data) of 256 gradation levels are measured at measurement distances that are separated from each other by the very small length. As shown in FIG. 12, AD values are obtained by converting the gradation data into digital numerical values and stored in the AD memory of the RAM 62.

Figure 5:
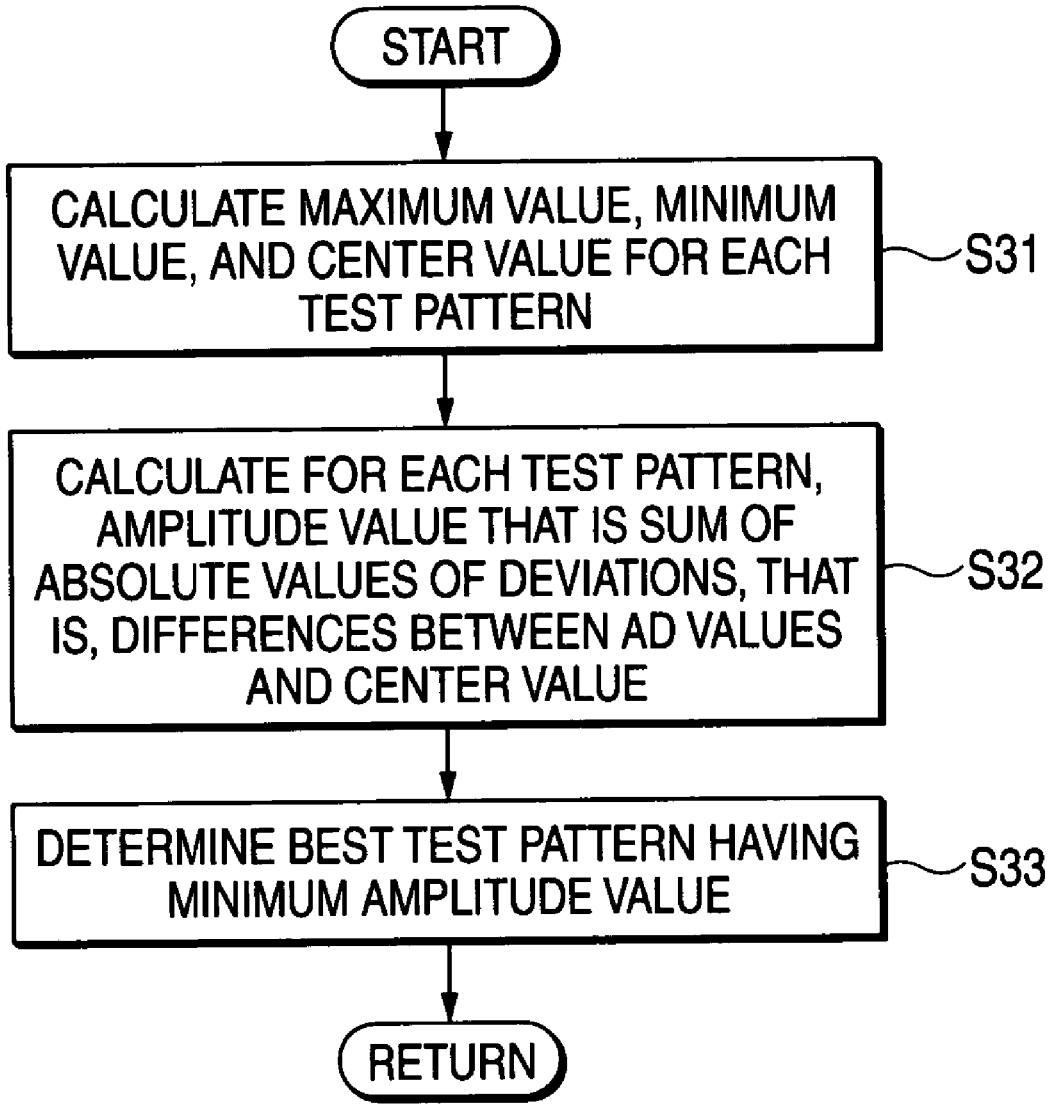
FIG. 5 is a flowchart for explaining a control for determining a test pattern number corresponding to the best pattern.

If the test pattern number N is equal to the maximum value "6" (S21: yes), which means that all test patterns have been printed, a computation process for determining a test pattern number N corresponding to the best pattern among the seven test pattern numbers is executed (S23; see FIG. 5). Upon a start of this control, a maximum value, a minimum value, and a center value are calculated on the basis of the AD values of each test-pattern (S31). For example, for the test pattern whose shift amount is equal to −12 dots, a maximum value (MAX), a minimum value (MIN), and their center value (CNT) of the AD values are calculated as shown in FIG. 10.

For the test pattern whose shift amount is equal to 0 dot, a maximum value (MAX), a minimum value (MIN), and their center value (CNT) of the AD values are calculated similarly as shown in FIG. 12. Then, amplitude values D0-D6 of the respective test patterns are calculated each of which is the sum of the absolute values of density deviations hd, that is, the differences between the AD values and the center value. The calculated amplitude values D0-D6 are stored in an amplitude value memory of the RAM 62 in a manner shown in FIG. 13 (S32).

Then, the best test pattern having a minimum amplitude value is determined on the basis of the amplitude values D0-D6 of the respective test patterns (S33). After completion of this control, a return is made to step S24 of the go/return printing position automatic correction control. For example, it is decided that the shift amount "0" of the test pattern 3 with which the gradation data have small variations and the amplitude value that is the sum of the absolute values of the density deviations hd is the smallest as shown in FIGS. 11 and 12. In the go/return printing position automatic correction control, since the 600-mode flag DF is set (S24: yes), the test pattern number N (=3) corresponding to the best pattern for the resolution 600 dpi is stored in the RAM 62 (S25).

Then, the number of shift dots corresponding to the test pattern number N (=3) and its vertical ruled lines are printed (S26). For example, as shown in FIG. 8, the number "0" of shift dots and a test pattern corresponding to the test pattern number 3 for the resolution 600 dpi are printed on the sheet in addition to the seven kinds of test patterns having the different shift amounts.

Figure 14:
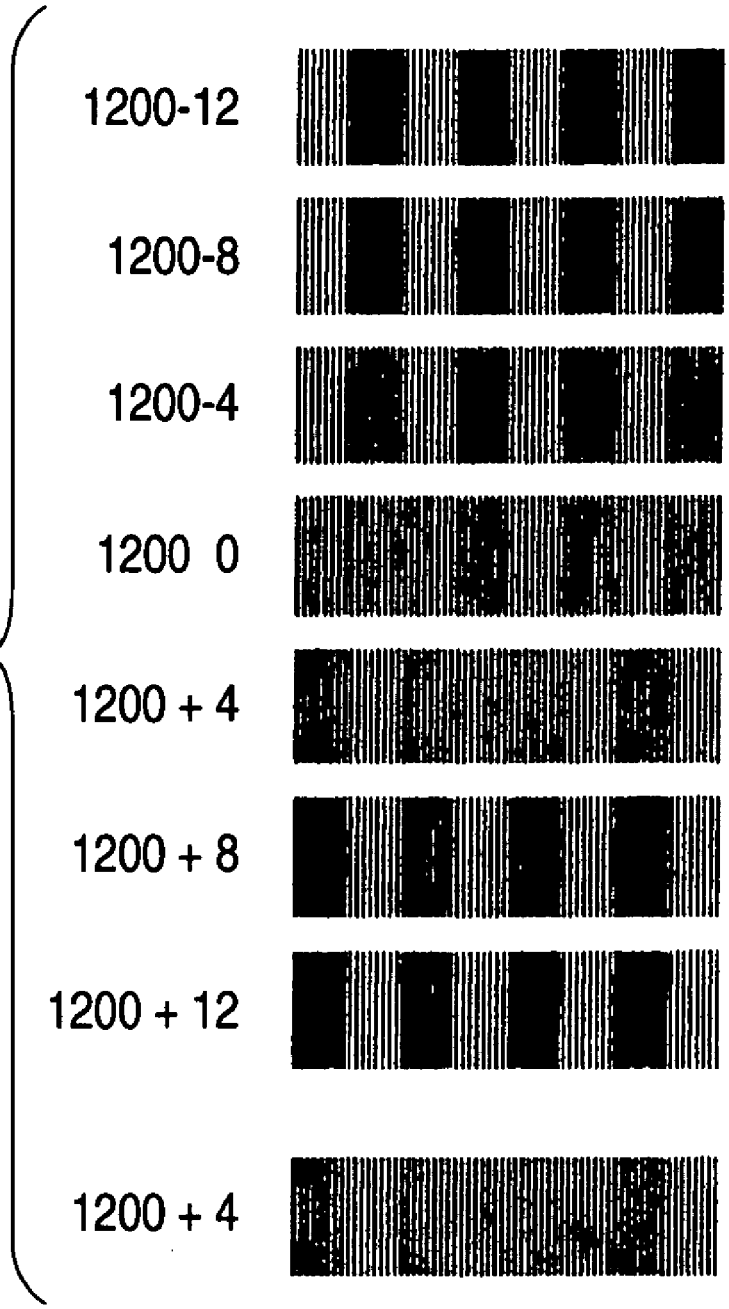
FIG. 14 shows a plurality of test patterns having different shift amounts that were printed at 1,200 dpi.

Then, the 600-mode flag DF is reset (S27). In this embodiment, since only the 600 mode and the 1,200 mode are available, the 1,200 mode is set upon resetting of the 600 mode. Therefore, step S14 and the following steps are executed again in a similar manner for the resolution 1,200 dpi. That is, seven kinds of test patterns are printed at the resolution 1,200 dpi (see FIG. 14) on the basis of the go-printing vertical ruled line data and the return-printing vertical ruled line data shown in FIGS. 6A and 6B (steps S15-S21). Where there are three or more resolution modes, {(number of resolution modes)−1} flags may be provided.

An amplitude value is calculated for each test pattern on the basis of a maximum value, a minimum value, and a center value, and a test pattern number 4 is determined as corresponding to the best pattern that produces a smallest amplitude value (S23). The number "+4" of shift dots and a test pattern corresponding to the test pattern number 4 are printed (see FIG. 14) (S28 and S29). In this manner, a plurality of test patterns in which the number of shift dots of return-printing with respect to go-printing is changed in plural stages are printed and the printed test patterns are read by a linear scan by the medium sensor 27 and then analyzed. Therefore, one of the test patterns can be selected automatically as the best test pattern.

Further, since the selected best test pattern and its number of shift dots are printed on a sheet, an inspector can visually check whether the printed test pattern, that is, the test pattern that has been judged best in the printing control, is really the best one.

Step S16, in particular, of the go/return position automatic correction control, the controller, etc., correspond to a test pattern printing control unit. Steps S15 and S16, in particular, of the go/return position automatic correction control, the controller, etc., correspond to a plural patterns printing instructing unit. Steps S17-S19 and S23, in particular, of the go/return position automatic correction control, the controller, etc., correspond to a best pattern detecting unit. Steps S28 and S29, in particular, of the go/return position automatic correction control, the controller, etc., correspond to a best pattern printing instructing unit. Step S32, in particular, of the control for determining a test pattern number corresponding to the best pattern, the controller, etc., correspond to a sum-of-deviations calculating unit. Step S33, etc., correspond to a pattern-selecting unit.

Second Embodiment

In the above embodiment, go-printing and return printing are conducted only once for each line along go/return direction. The invention is not limited to as herein described. Another control program for a go/return printing position adjustment control will be described with reference to flowcharts of FIGS. 15 and 5.

Figure 15:
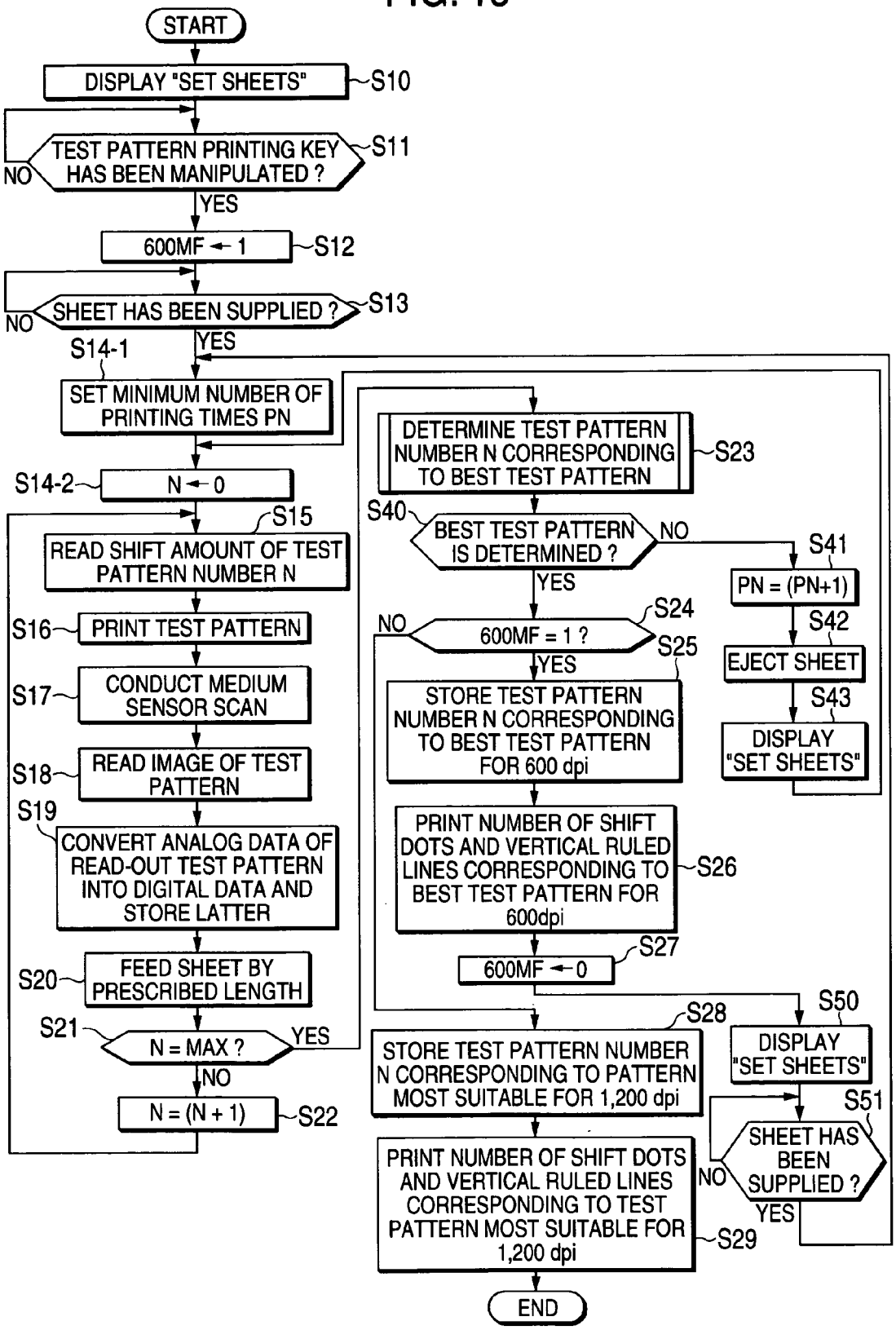
FIG. 15 is a flowchart of a go/return printing position correction control according to another embodiment of the present invention.

As shown in FIG. 15, upon a start of the control, a message "Set sheets." is displayed on the liquid crystal display 66 (S10). The inspector sets sheets for a test in the sheet feeder 2. When a test pattern printing key is manipulated (S11: yes), a 600-mode flag DF for setting a 600-dpi mode as a print resolution is set (S12).

If supply of a sheet has been detected by the medium sensor 27 (S13: yes), a minimum number of printing times PN is set to value such as "1" (S14-1), a test pattern number N is set to an initial value "0" (S14-2), and a shift amount of the test pattern number "0" is read (S15). Then, a test pattern is printed in such a manner that go-printing is conducted on the basis of the go-printing vertical ruled line data and return-printing is conducted on the same line (i.e., without feeding the sheet) on the basis of the return-printing vertical ruled line data and the shift amount (S16). The go/return printing is conducted a number of times equal to PN on the same line. Then, a vertical ruled line image of the printed test pattern is read (S18) by scanning it by moving the medium sensor 27 linearly (S17).

Then, the gradation data scanned-in by the medium sensor 27, that is, analog data, are converted into digital data (what is called AD values). The digital data are stored in an AD memory of the RAM 62 (Sl9). Then, the sheet is fed by a prescribed length (S20).

Then, if the test pattern number N is not equal to the maximum number (in this embodiment, 6) (S21: no), N is incremented by "1" (S22) and steps S15-S22 are executed again.

If the test pattern number N is equal to the maximum value "6" (S21: yes), which means that all test patterns have been printed, a computation process for determining a test pattern number N corresponding to the best pattern among the seven test pattern numbers is executed (S23; see FIG. 5). After completion of the control shown in FIG. 5, a return is made to step S40 of the go/return printing position automatic correction control. In step S40, whether or not the best test pattern is appropriately determined in step S33 (see FIG. 5) is judged based on prescribed conditions. For example, when a difference between the maximum amplitude value and the minimum amplitude value among the amplitude values D0-D6 of respective test patterns (see FIG. 13) is not less than a predetermined value, it is judged that the best test pattern is appropriately determined.

If the best test pattern is not appropriately determined (S40: no), the number of printing times PN is incremented by "1" (S41), the sheet is ejected (S42), and a message "Set sheets." is displayed (S43). Then, steps S14-2 to S40 are executed again.

If the best test pattern is appropriately determined (S40: yes), it is judged whether or not the 600-mode flag DF is set (S24). If the 600-mode flag DF is set (S24: yes), the test pattern number N corresponding to the best pattern for the resolution 600 dpi is stored in the RAM 62 (S25).

Then, the number of shift dots corresponding to the best test pattern number N and its vertical ruled lines are printed (S26).

Then, the 600-mode flag DF is reset (S27) and a message "Set sheets." is displayed (S50). If supply of a sheet has been detected by the medium sensor 27 (S51: yes), a minimum number of printing times PN for 1,200 dpi is set (S14-2) and the following steps are executed again in a similar manner for the resolution 1,200 dpi.

Step S40 in FIG. 15, etc., correspond to a detection result judging unit. Steps S41 to S43, etc., correspond to a re-detection executing unit.

Third Embodiment

In the first and second embodiments, the sensor reads each test pattern at the same time as the test pattern is printed or at a time immediately after the test pattern is printed. After all of the test patterns are read by the sensor, the amplitude values of respective test patterns are calculated, and a test pattern having the minimum amplitude value is selected as the best test pattern. The invention is not limited to as herein described. Another control program for a go/return printing position adjustment control will be described with reference to flowcharts of FIGS. 16 and 17.

Figure 16:
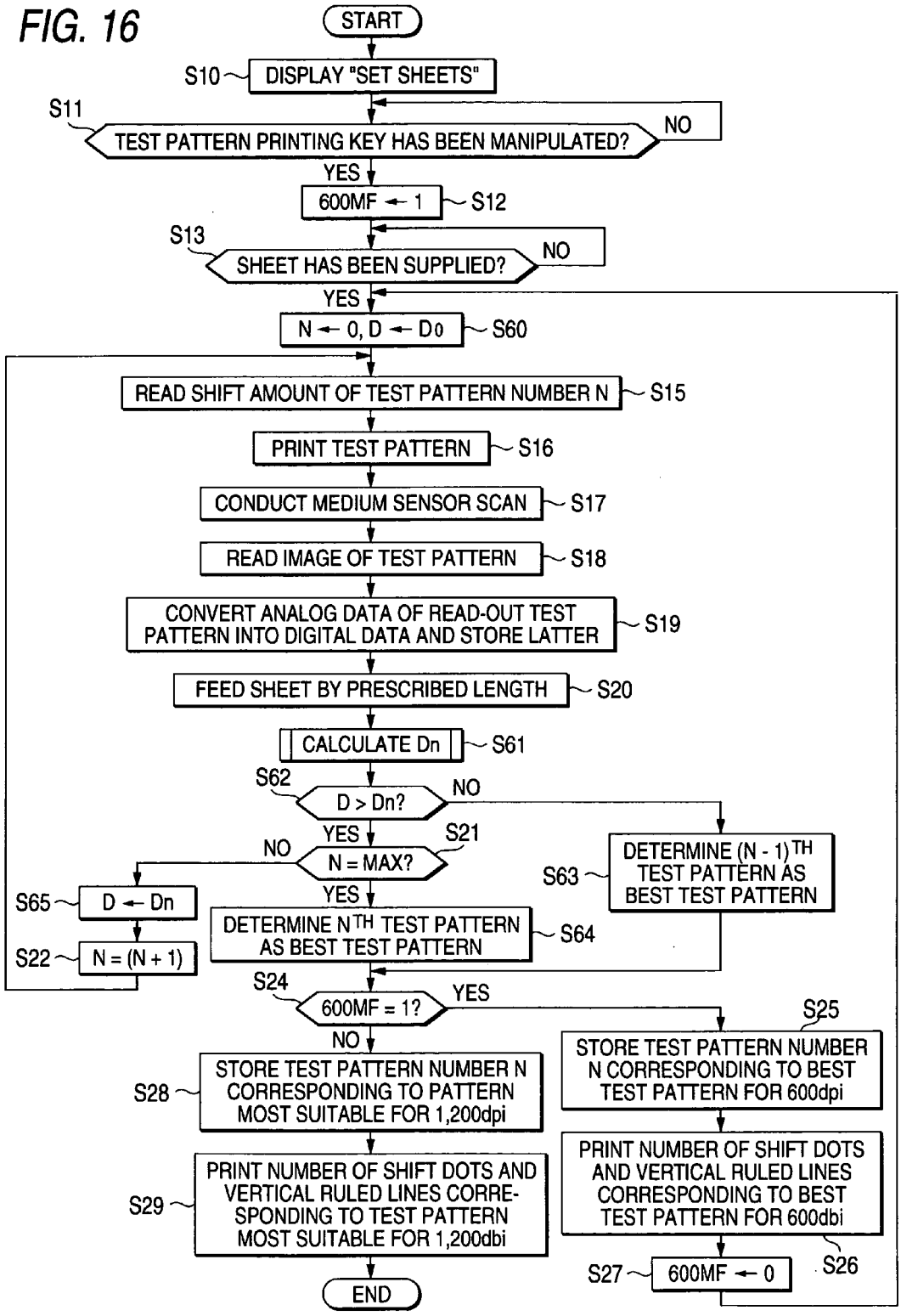
FIG. 16 is a flowchart of a go/return printing position correction control according to still another embodiment of the present invention.

In FIG. 16, the same procedures as those in the first or second embodiment are denoted by the same reference numerals, and description thereof will be omitted.

If supply of a sheet has been detected by the medium sensor 27 (S13: yes), a test pattern number N is set to an initial value "0" and a variable D for sum of density deviations is set to an initial value "$D_0$". A very large number that is large enough to be surely larger than an actual sum of density deviations can be set as "$D_0$". After a shift amount of the test pattern number "0" is read in step S15, a test pattern is printed in such a manner that go-printing is conducted on the basis of the go-printing vertical ruled line data and return-printing is conducted on the same line (i.e., without feeding the sheet) on the basis of the return-printing vertical ruled line data and the shift amount (S16). Then, a vertical ruled line image of the printed test pattern is read (S18) by scanning it by moving the medium sensor 27 linearly (S17).

Then, the gradation data scanned-in by the medium sensor 27, that is, analog data, are converted into digital data (what is called AD values). The digital data are stored in an AD memory of the RAM 62 (S19). Then, the sheet is fed by a prescribed length (S20), and in step S61, sum of the absolute values of density deviations Dn of the scanned-in test pattern is calculated.

Figure 17:
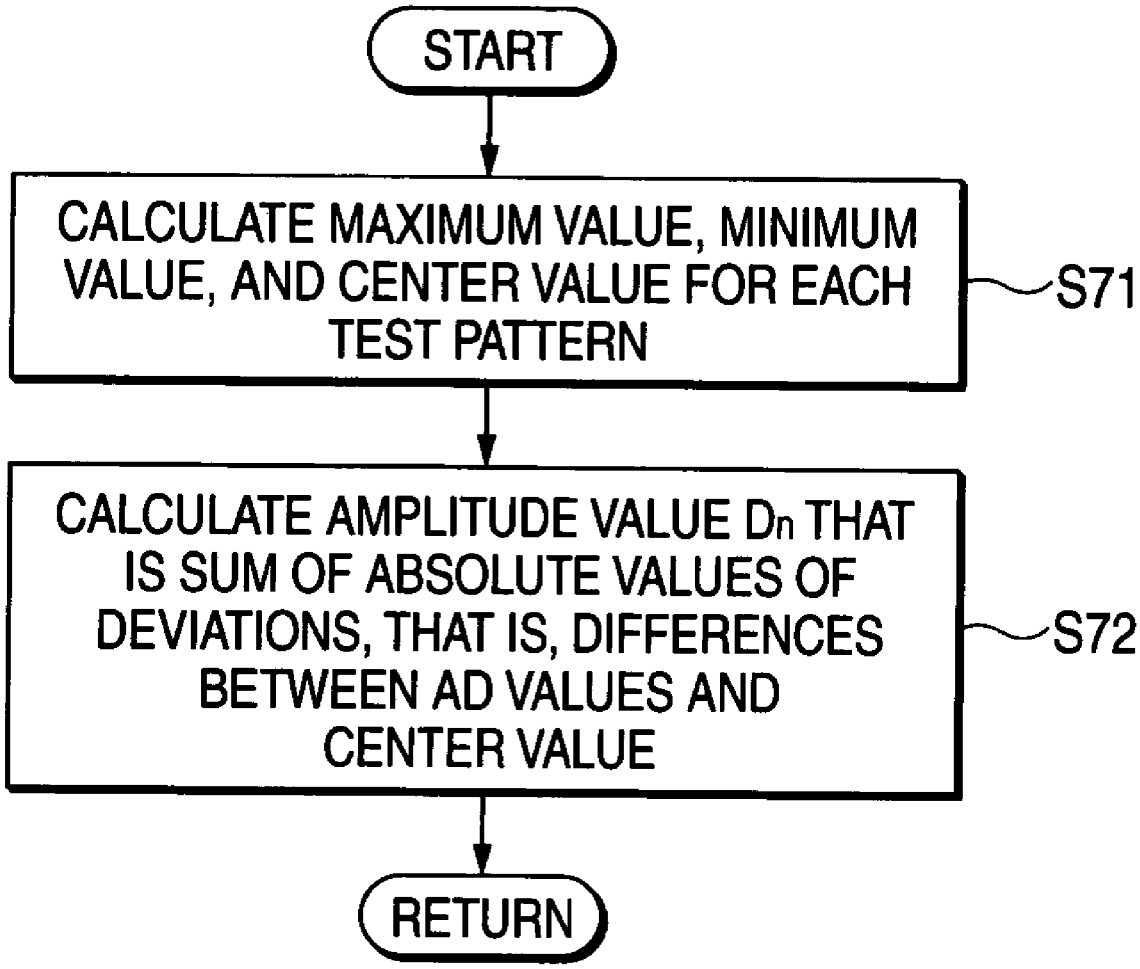
FIG. 17 is a flowchart for explaining a control for calculating sum of density deviations.

As shown in FIG. 17, upon a start of this calculation, a maximum value, a minimum value, and a center value are calculated on the basis of the AD values of the scanned-in test pattern (S71). Then, an amplitude value Dn of the test pattern is calculated which is the sum of the absolute values of density deviations, that is, the differences between the Ad values and the center value. After completion of this calculation, a return is made to step S62 in FIG. 16.

In step S62, it is judged whether the calculated amplitude value Dn is less than the variable D. If the amplitude value Dn is not less than the variable D (S62: no), a test pattern printed and scanned immediately before ($(N-1)^{th}$ test pattern) is determined as the best test pattern (S63), and then the control proceeds to step S24.

On the other hand, if the amplitude value Dn is less than the variable D (S62: yes), it is then judged whether the test pattern number N is equal to the maximum number (S21). If the test pattern number N is not equal to the maximum number (in this embodiment, 6) (S21: no), the currently calculated amplitude value Dn is substituted to the variable D (S65), N is incremented by "1" (S22) and the control proceeds to steps S15.

If the test pattern number N is equal to the maximum value "6" (S21: yes), a test pattern currently printed and scanned ($N^{th}$ test pattern) is determined as the best test pattern (S64), and then the control proceeds to step S24.

The above described control can be employed, to a ink jet printer in which printing characteristics of the print head is stable and reading accuracy of the sensor is high.

Step S61 in FIG. 16, etc., correspond to a sum-of-deviations calculating unit. Steps S21 and S62 to S64, etc., correspond to a sequential pattern selecting unit.

Next, modifications of the above embodiments will be described. Components other than modified ones will be given the same reference symbols as used in the embodiment.

1) The go-printing ruled line data and the return-printing ruled line data are not limited to those shown in FIGS. 6A and 6B; various data that enable correction of printing positional deviations can be employed.

2) A best test pattern and a shift amount may be printed in such a color (e.g., red) as to be recognized easily at a glance.

Figure 4:
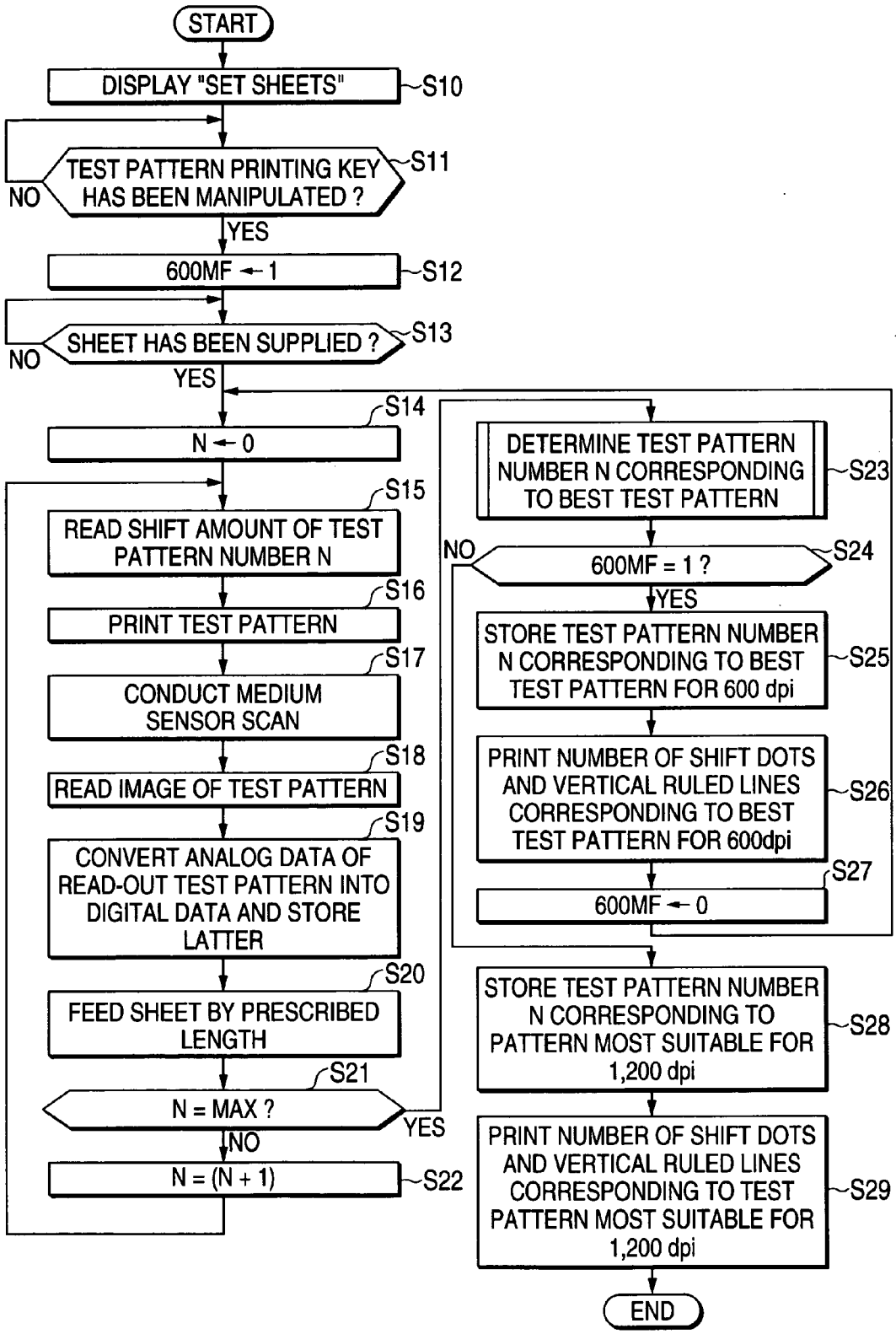
FIG. 4 is a flowchart for explaining a go/return printing position correction control.

3) The go/return printing position automatic correction control shown in FIG. 4 may be performed automatically every time the print head 23P is replaced.

4) The invention is not limited to the above embodiment and modifications. Other various modifications are possible without departing from the spirit and scope of the invention and, as such, the invention can be applied to various ink jet printers.

According to a first aspect of the invention, in addition to printing unit for printing on a printing medium by reciprocating a print head using a carriage, there are provided a sensor, test pattern printing control unit, plural patterns printing instructing unit, best pattern detecting unit, and best pattern printing instructing unit. A plurality of test patterns are printed while the test pattern printing interval of return-printing with respect to go-printing is changed in plural stages in such a manner that each test pattern is printed in a superimposed manner by reciprocation of the carriage. The printed test patterns are scanned-in by the sensor and analyzed. Therefore, one of the scanned-in test patterns can be selected automatically as the best one on the basis of analysis results, and can be printed on the printing medium. Therefore, an inspector can visually check whether the additionally printed test pattern, that is, the test pattern that has been judged best in the printing control, is really the best one.

According to a second aspect of the invention, each test pattern printing interval has information indicating it and the best pattern printing instructing unit causes the printing unit to print, together with the additional test pattern, information indicating its test pattern printing interval. Since the information indicating the additional test pattern interval is printed together with the additional test pattern, an inspector can recognize a shift amount of return-printing on the basis of the information indicating the additional test pattern interval.

According to a third aspect of the invention, the best pattern detecting unit comprises sum-of-deviations calculating unit for calculating, for each of the test patterns, a sum of density deviations of a number of vertical ruled lines with respect to a density center value of the vertical ruled lines. Therefore, when plural kinds of test patterns are printed while the shift amount is changed in such a manner that a plurality of vertical ruled lines shown in FIG. 6A is printed in go-printing and a plurality of vertical ruled lines shown in FIG. 6B is printed in return-printing, a fine test pattern may occur that consists of 4-dot-width lines each of which is a combination of a 2-dot-width vertical ruled line of go-printing and a 2-dot-width vertical ruled line of return-printing.

When such a best test pattern is read by the sensor, analog data that are output from the sensor have very small density differences. Calculating the sum of density deviations of a number of vertical ruled lines of each test pattern with respect to a density center value of the vertical ruled lines makes it possible to easily select, as the best test pattern, a test pattern having the smallest sum of deviations.

According to a fourth aspect of the invention, the sensor is capable of detecting at least one of a front end, a rear end, and a width of the printing medium. This sensor makes it possible to detect not only the front end and the rear end of a printing medium but also its width.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An ink jet printer, comprising:

a printing unit having a carriage and a print head in which a plurality of ink jet nozzles are arranged in plural columns, the printing unit printing on a printing medium while reciprocating the print head by the carriage for go-printing and return-printing;

a sensor disposed on the carriage and having a light-emitting portion for emitting light toward the printing medium and a light-receiving portion for receiving reflected light from the printing medium;

a test pattern printing control unit that causes the printing unit to print a test pattern in which vertical ruled lines are arranged with a prescribed pitch;

a plural patterns printing instructing unit that causes the printing unit to print a plurality of test patterns while changing a test pattern printing interval of the return-printing with respect to the go-printing in plural stages;

a best pattern detecting unit for scanning-in the printed test patterns with the sensor and for automatically selecting a best test pattern from the scanned-in test patterns; and a best pattern printing instructing unit that causes the printing unit to print information indicating an image of the selected best test pattern on the printing medium, wherein the best pattern printing instructing unit causes the printing unit to reprint the selected best test pattern from the scanned-in test patterns on the printing medium at the test pattern printing interval that produces the selected best test pattern as information indicating the image of the selected best test pattern, wherein the best pattern detecting unit comprises:

a sum-of-deviations calculating unit for calculating, for each of the test patterns, a sum of density deviations of a number of vertical ruled lines with respect to a density center value of the vertical ruled lines; and a pattern selecting unit for selecting the best test pattern from the scanned-in test patterns, the best test pattern having the minimum sum of density deviations calculated by the sum-of-deviations calculating unit.

2. The ink jet printer according to claim 1, further comprising:

a detection result judging unit for judging whether a detection made by the best pattern detecting unit is appropriate; and a re-detection executing unit that causes the printing unit to print the plurality of test patterns again while changing a printing condition and causes the sensor to scan the printed test patterns again when the detection result judging unit judges that the detection made by the best pattern detecting unit is not appropriate.

3. The ink jet printer according to claim 2, wherein the detection result judging unit judges whether a difference between a maximum value and a minimum value among sum of density deviations of respective test patterns is not less than a predetermined value, and judges that the detection made by the best pattern detecting unit is appropriate when the difference is not less than the predetermined value.

4. An ink jet printer, comprising:

a printing unit having a carriage and a print head in which a plurality of ink jet nozzles are arranged in plural columns, the printing unit printing on a printing medium while reciprocating the print head by the carriage for go-printing and return-printing;

a sensor disposed on the carriage and having a light-emitting portion for emitting light toward the printing medium and a light-receiving portion for receiving reflected light from the printing medium;

a test pattern printing control unit that causes the printing unit to print a test pattern in which vertical ruled lines are arranged with a prescribed pitch;

a plural patterns printing instructing unit that causes the printing unit to print a plurality of test patterns while changing a test pattern printing interval of the return-printing with respect to the go-printing in plural stages;

a best pattern detecting unit for scanning-in the printed test patterns with the sensor and for automatically selecting a best test pattern from the scanned-in test patterns;

a best pattern printing instructing unit that causes the printing unit to print information indicating an image of the selected best test pattern on the printing medium, wherein the best pattern printing instructing unit causes the printing unit to reprint the selected best test pattern from the scanned-in test patterns on the printing medium at the test pattern printing interval that produces the selected best test pattern as information indicating the image of the selected best test pattern;

a detection result judging unit for judging whether a detection made by the best pattern detecting unit is appropriate; and a re-detection executing unit that causes the printing unit to print the plurality of test patterns again while changing a printing condition and causes the sensor to scan the printed test patterns again when the detection result judging unit judges that the detection made by the best pattern detecting unit is not appropriate, wherein the re-detection executing unit causes the printing unit to print the plurality of test patterns while changing a number of printing times, and the printing unit conducts go-printing and return-printing for each line along a go/return direction a number of times equal to the changed printing times.

5. An ink jet printer, comprising:

a printing unit having a carriage and a print head in which a plurality of ink jet nozzles are arranged in plural columns, the printing unit printing on a printing medium while reciprocating the print head by the carriage for go-printing and return-printing;

a sensor disposed on the carriage and having a light-emitting portion for emitting light toward the printing medium and a light-receiving portion for receiving reflected light from the printing medium;

a test pattern printing control unit that causes the printing unit to print a test pattern in which vertical ruled lines are arranged with a prescribed pitch;

a plural patterns printing instructing unit that causes the printing unit to print a plurality of test patterns while changing a test pattern printing interval of the return-printing with respect to the go-printing in plural stages;

a best pattern detecting unit for scanning-in each printed test pattern with the sensor and for automatically selecting a best test pattern from the plurality of test patterns; and a best pattern printing instructing unit that causes the printing unit to print best test pattern related information on the printing medium, wherein the best pattern detecting unit comprises:

a sum-of-deviations calculating unit for calculating, for each of the test patterns, a sum of density deviations of a number of vertical ruled lines with respect to a density center value of the vertical ruled lines; and a sequential pattern selecting unit for selecting a test pattern scanned immediately before a test pattern that is currently scanned by the sensor as the best test pattern when the sum of density deviations of the test pattern currently scanned is equal to or more than that of the test pattern scanned immediately before.

6. The ink jet printer according to claim 5, wherein the sequential pattern selecting unit selects a test pattern that is currently scanned as the best test pattern when the test pattern currently scanned is the last test pattern among the plurality of test patterns.

7. An ink jet printer, comprising:

a printing unit having a carriage and a print head in which a plurality of ink jet nozzles are arranged in plural columns, the printing unit printing on a printing medium while reciprocating the print head by the carriage for go-printing and return-printing;

a sensor disposed on the carriage and having a light-emitting portion for emitting light toward the printing medium and a light-receiving portion for receiving reflected light from the printing medium;

a test pattern printing control unit that causes the printing unit to print a test pattern in which vertical ruled lines are arranged with a prescribed pitch;

a plural patterns printing instructing unit that causes the printing unit to print a plurality of test patterns while changing a test pattern printing interval of the return-printing with respect to the go-printing in plural stages;

a best pattern detecting unit for scanning-in the printed test patterns with the sensor and for automatically selecting a best test pattern from the scanned-in test patterns; and a best pattern printing instructing unit that causes the printing unit to print information indicating an image of the selected best test pattern on the printing medium, wherein the best pattern printing instructing unit causes the printing unit to reprint the selected best test pattern from the scanned-in test patterns on the printing medium at the test pattern printing interval that produces the selected best test pattern as information indicating the image of the selected best test pattern, wherein each test pattern has a plurality of first regions and a plurality of second regions, each first region having both a plurality of dots that is printed by go-printing and a plurality of dots that is printed by return-printing, each second region having only a plurality of dots that is printed by one of go-printing and return-printing, a number of the sum of the dots per unit area of the first region being equal to a number of dots per unit area of the second region.

8. The ink jet printer according to claim 7, wherein the plurality of first regions and the plurality of second regions are disposed alternately on each test pattern.

9. An ink jet printer, comprising:

a printing unit having a carriage and a print head in which a plurality of ink jet nozzles are arranged in plural columns, the print unit printing on a printing medium while reciprocating the print head by the carriage for go-printing and return-printing;

a sensor disposed on the carriage and having a light-emitting portion for emitting light toward the printing medium and a light-receiving portion for receiving reflected light from the printing medium;

a test pattern printing control unit that causes the printing unit to print a test pattern in which vertical ruled lines are arranged with a prescribed pitch;

a plural patterns printing instructing unit that causes the printing unit to print a plurality of test patterns while changing a test pattern printing interval of the return-printing with respect to the go-printing in plural stages;

a best pattern detecting unit for scanning-in the printed test patterns with the sensor and for automatically selecting a best test pattern from the scanned-in test patterns; and wherein the best pattern detecting unit comprises:

a sum-of-deviations calculating unit for calculating, for each of the test patterns, a sum of density deviations of a number of vertical ruled lines with respect to a density center value of the vertical ruled lines; and a pattern selecting unit for selecting the best test pattern from the scanned-in test patterns, the best test pattern having the minimum sum of density deviations calculated by the sum-of-deviations calculating unit.

10. The ink jet printer according to claim 9, further comprising a best pattern printing instructing unit that causes the printing unit to print an additional pattern on the printing medium at the test pattern printing interval that produces the selected best test pattern.

11. The ink jet printer according to claim 9, further comprising:

a detection result judging unit for judging whether a detection made by the best pattern detecting unit is appropriate; and a re-detection executing unit that causes the printing unit to print the plurality of test patterns again while changing a printing condition and causes the sensor to scan the printed test patterns again when the detection result judging unit judges that the detection made by the best pattern detecting unit is not appropriate.

12. The ink jet printer according to claim 11, wherein the detection result judging unit judges whether a difference between a maximum value and a minimum value among sum of density deviations of respective test patterns is not less than a predetermined value, and judges that the detection made by the best pattern detecting unit is appropriate when the difference is not less than the predetermined value.

13. An ink jet printer, comprising:

a printing unit having a carnage and a print head in which a plurality of ink jet nozzles are arranged in plural columns, the print unit printing on a printing medium while reciprocating the print head by the carriage for go-printing and return-printing;

a sensor disposed on the carriage and having a light-emitting portion for emitting light toward the printing medium and a light-receiving portion for receiving reflected light from the printing medium;

a test pattern printing control unit that causes the printing unit to print a test pattern in which vertical ruled lines are arranged with a prescribed pitch;

a plural patterns printing instructing unit that causes the printing unit to print a plurality of test patterns while changing a test pattern printing interval of the return-printing with respect to the go-printing in plural stages; and a best pattern detecting unit for scanning-in the printed test patterns with the sensor and for automatically selecting a best test pattern from the scanned-in test patterns;

wherein each test pattern has a plurality of first regions and a plurality of second regions, each first region having both a plurality of dots that is printed by go-printing and a plurality of dots that is printed by return-printing, each second region having only a plurality of dots that is printed by one of go-printing and return-printing, a number of the sum of the dots per unit area of the first region being equal to a number of dots per unit area of the second region.

14. The ink jet printer according to claim 13, further comprising a best pattern printing instructing unit that causes the printing unit to print an additional pattern on the printing medium at the test pattern printing interval that produces the selected best test pattern.

15. The ink jet printer according to claim 13, wherein the plurality of first regions and the plurality of second regions are disposed alternately on each test pattern.

16. The ink jet printer according to claim 13, wherein each test pattern has a common configuration of the plurality of first regions and the plurality of second regions.

* * * * *